US005189787A

United States Patent [19]

Reed et al.

[11] Patent Number: 5,189,787

[45] Date of Patent: Mar. 2, 1993

[54] ATTACHMENT OF A FLEXIBLE CIRCUIT TO AN INK-JET PEN

[75] Inventors: Douglas J. Reed, Corvallis, Oreg.; Kenneth J. Courian, San Diego, Calif.; Gary G. Lutnesky, Corvallis, Oreg.; Milo A. Undlin, Corvallis, Oreg.; Terry M. Lambright, Corvallis, Oreg.

[73] Assignee: Hewlett-Packard Company, Palo Alto, Calif.

[21] Appl. No.: 737,623

[22] Filed: Jul. 30, 1991

[51] Int. Cl.[5] ..... H05B 3/00

[52] U.S. Cl. ..... 29/831; 156/309.6; 174/254; 346/140 A

[58] Field of Search ..... 29/831; 156/309.6; 174/254; 346/140

[56] References Cited

U.S. PATENT DOCUMENTS

| | | | |
|---|---|---|---|
| 3,219,742 | 11/1965 | Reinert | 156/309.6 |
| 3,634,601 | 1/1972 | Pauza | 439/83 |
| 4,500,895 | 2/1985 | Buck et al. | 346/140 |

OTHER PUBLICATIONS

*Development of a High-Resolution Thermal Inkjet Printhead*, Hewlett-Packard Journal, Oct. 1988, pp. 55-61.

*Primary Examiner*—P. W. Echols

[57] ABSTRACT

A flexible circuit is staked to an ink-jet pen body to resist peeling from the body and to provide a flat surface to which mechanisms for enclosing the pen nozzles can be sealed. Also disclosed is a staking apparatus and method for ensuring flatness and uniform bonding of the staked circuit.

12 Claims, 7 Drawing Sheets

ATTACHMENT OF A FLEXIBLE CIRCUIT TO AN INK-JET PEN

BACKGROUND OF THE INVENTION

This invention pertains to a method and apparatus for attaching a flexible circuit to the surface of an ink-jet pen.

Certain ink-jet printers, such as that manufactured by Hewlett-Packard Company and designated the "DeskJet," use replaceable pens. The pens are of the thermal ink-jet type and comprise an ink reservoir that is in fluid communication with a print head that is mounted to the pen body. An orifice plate defines the exterior surface of the print head. The plate includes a plurality of orifices that are shaped as nozzles through which ink drops are discharged. Each nozzle has associated with it a resistor that is selectively driven (heated) with sufficient current for vaporizing ink in the vicinity of the nozzle, thereby forcing through the nozzle a drop of ink.

Electrically conductive lines or "traces" are carried on a thin, flexible plastic strip that is mounted to the exterior of the pen. The composite of the flexible strip and traces is hereafter referred to as a flexible circuit. The traces each connect at one end with a lead on the print head that carries current to a nozzle resistor. The other end of each trace terminates in a contact pad.

The contact pads on the pen-mounted flexible circuit connect with contacts on a corresponding circuit that is mounted to a carriage that holds the pen within the printer. Signals for driving the nozzle resistors are generated by a microprocessor and associated drivers that apply the signals to the resistors via the flexible circuit traces.

In the past, the flexible circuit was attached to the pen body by a thermoplastic adhesive that was applied in the form of discrete patches between the flexible circuit and the pen body. One problem with the use of the adhesive technique is that it is difficult to apply the adhesive uniformly across the entire surface area of the flexible circuit. Areas of the flexible circuit that receive no adhesive, particularly the edges and corners of the circuit, may lift from the pen surface, thereby causing the circuit to peel from the pen body when the pen is manipulated by the user or moved by the printer carriage. Moreover, the adhesive may re-melt in the event the pen is exposed to a high-temperature environment.

In the process of manufacturing a black-ink pen for a DeskJet ink-jet printer, the ink reservoir is filled and the print head is primed. Specifically, suction is applied to the exterior of the orifice plate after the pen reservoir is filled with ink. The suction draw ink from the reservoir through the nozzles to remove air so that the print head will operate properly. One mechanism for applying the suction to the nozzles includes a flexible cap that is pressed against the orifice plate to substantially enclose the nozzles so that they are in fluid communication with a small internal chamber defined by the cap. Suction is then applied to the chamber. Once the pen is primed, the suction and cap are removed.

SUMMARY OF THE INVENTION

This invention is directed to a method and apparatus for attaching a flexible circuit to an ink-jet pen by a staking technique so that the circuit is permanently and uniformly bonded to the exterior surface of the pen body, thereby preventing the flexible circuit from peeling from the pen body.

As another aspect of this invention, the flexible circuit is provided with additional or "dummy" traces which do not connect with nozzle resistors but do enhance the bond between the circuit and the pen body.

As another aspect of this invention, the flexible circuit and pen body are configured in a manner such that, in conjunction with the inventive method of attaching the circuit to the pen body, there is provided an improved technique for enclosing the pen nozzles to provide, for example, long term storage or suction-type priming of an ink-jet pen. In particular, a cap member that is moved against the pen to enclose the pen nozzles during a priming operation will tightly seal against a smooth, planar surface region on the flexible circuit portion that surrounds the orifice plate. Applying the cap to the flexible circuit, and not to the orifice plate, has been found to advantageously avoid ink leaking and mixing that might otherwise occur were the cap member sealed against the orifice plate during the priming operation. Further, ink evaporation occurring during long term storage is minimized.

The method of the present invention for attaching the flexible circuit to the pen body employs a staking apparatus that includes a gimbal-mounted staking head that produces a very flat outer surface of the attached circuit, irrespective of minor surface irregularities or variations from pen to pen in the planarity of the pen body surface prior to staking.

DETAILED DESCRIPTION OF A PREFERRED EMBODIMENT

Figure 1:
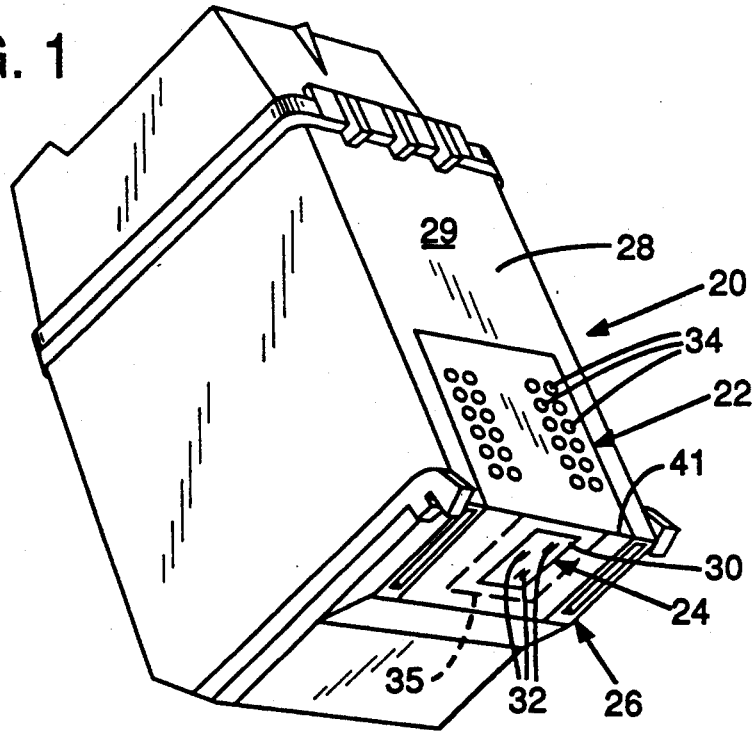
FIG. 1 is a perspective view of an ink jet pen that has a flexible circuit attached thereto in accordance with the present invention.

FIG. 1 depicts a perspective view of an ink-jet pen 20 that has applied to it a flexible circuit 22 that connects with a corresponding circuit on a printer carriage (not shown) for delivering control signals to a print head 24 that is mounted to the nose 26 of the pen 20.

The pen depicted in the drawings is a color pen, the plastic body 28 of which carries ink reservoirs of three primary colors (cyan, magenta and yellow). The inks may be combined for printing a variety of colors, including black.

The print head 24 includes on its outer surface an orifice plate 30 that has formed in it three separate sets of nozzles 32, each nozzle set 32 being in fluid communication with a reservoir compartment that carries a single color of ink. Each nozzle has associated with it a thin-film resistor that is selectively driven (heated) with sufficient current for vaporizing ink in the vicinity of a nozzle, thereby forcing through the nozzle a drop of ink.

The flexible circuit 22 includes a plurality of contact pads 3 that mate with corresponding contacts mounted in the printer carriage (for clarity, only a few of the contact pads 34 are depicted in FIG. 1). Extending between each contact pad 34 and the print head 24 is an electrically conductive element, such as a copper line or trace 36 (see FIG. 5). The traces 36 carry the current between the contact pads 34 and the individual resistors in the print head 24.

As mentioned above, the flexible circuit 22 is staked to the pen body 28; that is, the circuit is applied to the exterior surface of the pen body under pressure and heat sufficient for causing plastic flow of the pen body so that the underside of the flexible circuit 22 is joined to the plastic body 28.

In accordance with the present invention, the flexible circuit 22 and pen 20 are designed so that upon attachment of the circuit 22 to the pen 20 there is defined on the circuit a very flat, four-sided surface portion, hereafter referred to as the sealing region 35. The sealing region 35 surrounds the print head 24 and is disposed in a single plane. For illustrative purposes, the sealing region 35 is shown in FIG. 1 as outlined in dashed lines on three sides, the fourth side being defined by the line 41 where the circuit is bent at the junction of the nose 26 and front face 29 of the pen.

As described more fully below, the sealing region 35 provides a flat area against which a correspondingly-shaped edge of a cap member may be pressed. The flatness of the sealing region 35 and the resilience of the cap member provide sealing contact between the cap member and flexible circuit 22, thereby substantially enclosing the orifice plate 30 and the nozzle sets 32 carried thereon. The cap member may be, for example, part of an apparatus for priming the pen, whereby suction is applied to the interior of the cap member for drawing ink through the print head nozzles 32 as mentioned above. Alternatively, the cap member may be provided for enclosing the orifice plate 30 during storage.

Preferably, the nose surface portion 38 (FIG. 2) to which part of the circuit 22 is staked is formed in a manner such that the plastic flow in the surface portion 38 will produce a very flat surface, irrespective of local irregularities or sloping of the surface prior to the staking operation.

Figure 2:
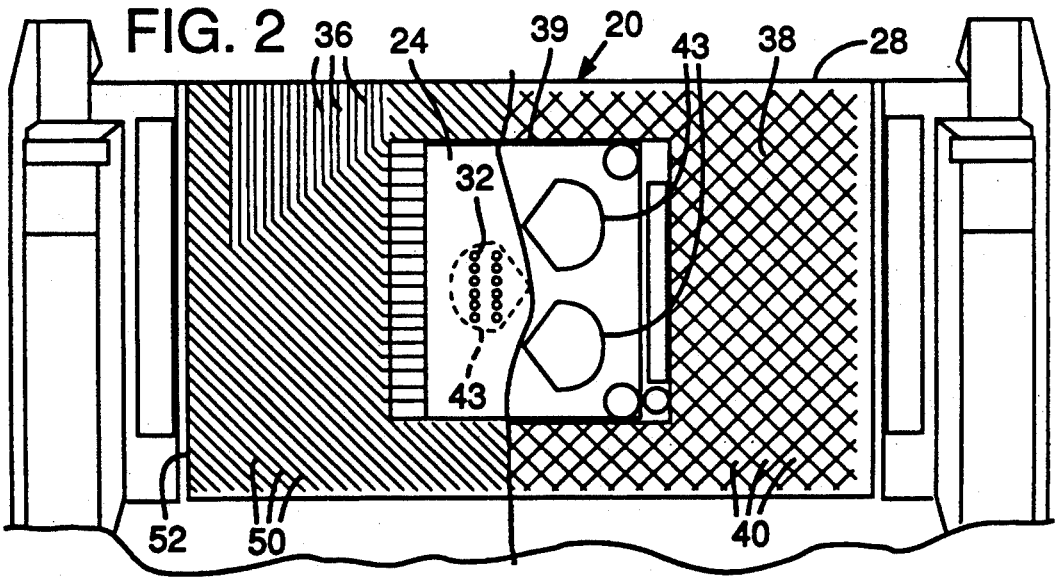
FIG. 2 is an enlarged bottom view showing, in partial section, the nose portion of an ink-jet pen.
Figure 4:
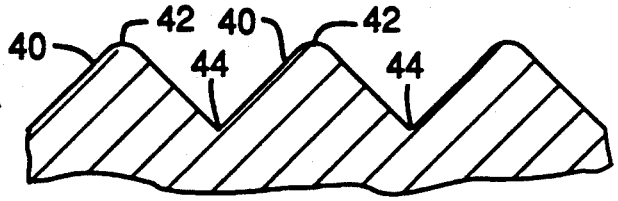
FIG. 4 is a cross sectional view of the embossments shown in FIG. 3.
Figure 3:
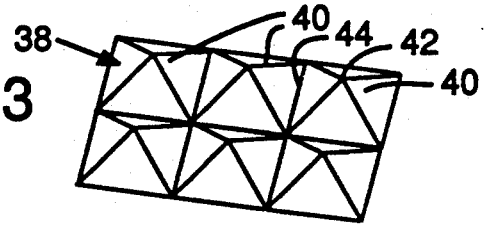
FIG. 3 an enlarged perspective view showing an embossed surface portion of the pen nose to which surface portion part of the flexible circuit is later attached.

With particular reference to FIGS. 2-4, the nose surface portion 38 nearest the front face 29 of the pen body 28 includes a recess 39 into which is installed the print head 24. Three chambers 43 are formed in the pen nose 26, each chamber 43 providing fluid communication between the installed print head 24 and one of the three ink reservoirs in the pen body 28. Ink flows through a chamber 43 to a set 32 of nozzles that align with the chamber when the print head is installed.

The surface 38 away from the print head 24 is formed so that, prior to staking, it is embossed with a multitude of pyramid-like bosses 40 arranged in a regular matrix. The arrangement of bosses 40 defines (FIG. 4) peaks 42 and valleys 44 in the surface 38. The peaks 42 flow into the valleys 44 during staking to correspond to the plane defined by the head of the staking apparatus, as described more fully below. In a preferred embodiment, the width (i.e., distance between valleys 44) of each boss 40 is about 0.25 mm and the maximum height is about 0.13 mm. The embossment is formed, for example, by injection molding.

Figure 5:
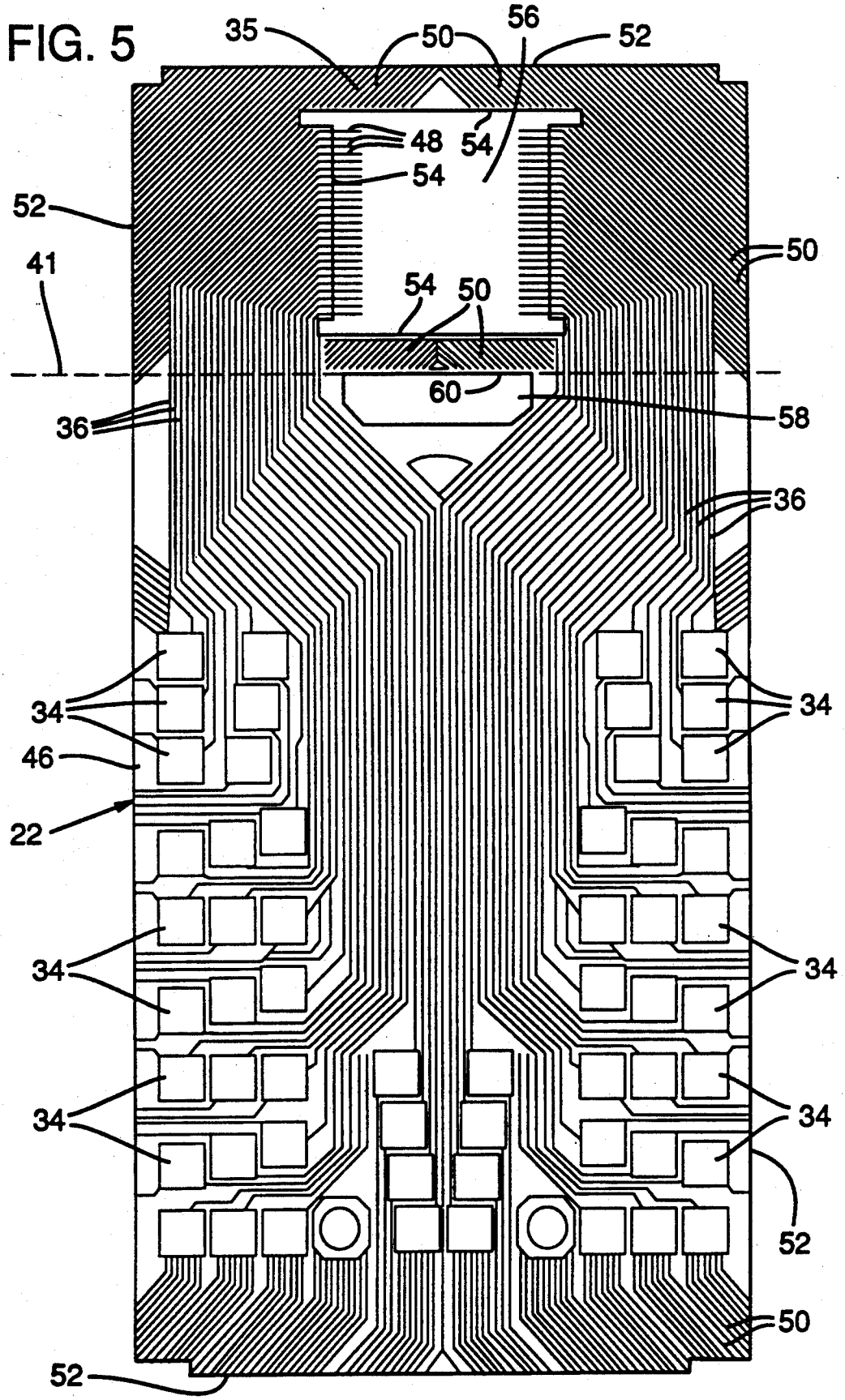
FIG. 5 is a diagram of a flexible circuit that is bent and attached to the ink-jet pen.

Referring to FIGS. 1 and 5, a flexible circuit 22 formed in accordance with the present invention includes a thin, flexible, generally rectangular strip of polyimide 46. In a preferred embodiment, the strip 46 is about 0.05 mm thick. The underside (that is, the side of the strip 46 that is staked to the pen body 28) has permanently bonded thereto a multitude of conductive copper traces 36 mentioned above. The traces are attached to the polyimide strip in a manner such that they protrude slightly (e.g., 0.04 mm) from the strip underside. The protruding traces define a ribbed underside in the circuit 22, which increases the surface area of the circuit underside by providing rough, protruding elements, which increase the strength of the staking bond between the circuit and pen.

As noted earlier, the traces 36 each connect at one end to a contact pad 34. The opposing ends of the traces 36 terminate in free ends or beams 48 that are welded to corresponding conductors carried on the print head 24 (not shown in FIG. 5) for applying current to the resistor nozzles.

A hole 56 into which the beams 48 project is formed in the strip 46 so that the print head orifice plate 30 is exposed once the circuit 22 is mounted to the pen body 28. Another, somewhat oblong, hole 58 is formed near the first hole 56 and has one long edge 60 generally collinear with the bend line 41 mentioned above. The presence of the hole 58 reduces the amount of bending stress imparted in the circuit when the circuit is folded along bend line 41.

In accordance with the present invention the flexible circuit 22 is constructed with a multitude of additional, "dummy" traces 50 that cover nearly all of the underside of the strip 46 where the circuit 22 is staked to the nose surface 38 and where there are not active traces 36. The inclusion of the dummy traces 50 increases the surface area of the circuit underside, hence enhancing the strength of the staked bond between the circuit 22 and the pen body 28 by increasing the above-mentioned ribbing (i.e., protruding traces) in the circuit underside.

As another aspect of this invention, the live traces 36 and dummy traces 50 are arranged on the polyimide strip 46 so that as viewed in plan (FIG. 5) the traces intersect the outer edges 52 of the strip 46 at oblique angles. The oblique intersection arrangement also occurs where the dummy traces 50 intersect the inner edges 54 of the print head hole 56 in the circuit strip 46, and where the dummy traces 50 intersect the side 60 of hole 58.

The oblique intersection of traces 36, 50 and circuit strip edges 52, 54, 60 causes the edges to resist peeling of the circuit 22 from the pen body in the event the edges of the circuit are rubbed against an object, for example, as when the pen is inserted into the printer carriage or serviced within the printer in such a manner that a shearing or tearing is directed against the edge of the circuit strip 46. Peeling would be more likely to occur were the traces arranged to intersect the edges 52, 54, 60 at perpendicular or parallel orientations relative to the edges.

The inclusion of the dummy traces 50, constructed as they are of heat-conducting material, also makes more uniform the distribution of the staking heat over the circuit 22. The uniform heat distribution increases the evenness of the plastic flow beneath the entire strip 46 during the staking operation.

Turning now to the apparatus employed for staking the flexible circuit 22 to the pen body 28, and with particular reference to FIGS. 6–9, the staking apparatus 80 includes an L-shaped support bracket 82 for supporting the primary components of the apparatus, and for mounting the apparatus to a linear bearing for reciprocal movement during operation of the apparatus 80 as described below.

The support leg 84 of the bracket 82 has fastened to its underside a generally U-shaped member, designated as X-yoke 86, that includes a base 88 and two parallel, elongated arms 90, one arm protruding downwardly from each end of the base 88. The X-yoke 86 is secured to the support leg 84 of the bracket 82 by threaded fasteners 92. The precise position of the X-yoke 86 relative to the support bracket 82 is maintained by a pair of dowels 94 that extend between the bracket 82 and yoke base 88.

The lower end of each X-yoke arm 90 is pivotally attached to a long side 99 of a generally oblong-shaped (FIG. 9) gimbal frame 98. The gimbal frame 98 is rigid and fits between the X-yoke arms 90. The pivotal connection between the yoke arms 90 and gimbal frame 98 is made with a frictionless flexural pivot bearing (flex pivot) 100, such as that manufactured under the trademark "Free-Flex" by Lucas Aerospace Power Transmission Corporation, Series Type 5000. One end 102 (FIG. 6) of the flex pivot 100 is anchored in the gimbal frame 98 and the other end 104 of the flex pivot 100 is anchored in the X-yoke arm 90. The pivotal connection between the X-yoke 86 and the gimbal frame 98 defines an X axis that extends through the center of the gimbal frame 98. The gimbal frame 98 is, therefore, rotatable in either of opposing directions about the X axis.

Another U-shaped member, designated Y-yoke 110, is rotatably mounted to the opposing short sides 101 of the gimbal frame 98. More particularly, the Y-yoke 110 includes a base plate 112 having a downwardly depending leg 114 attached to each side of the base plate 112. The lowermost ends of the legs 114 are shaped to fit within the gimbal ring 98 and to be pinned thereto for rotation about a Y axis (which is generally perpendicular to the X axis) by flex pivots 100. In this regard, the Y-yoke 110 is configured so that there is sufficient clearance between the Y-yoke 110 and the interior of the X-yoke 86 to permit rotation of the Y-yoke in either of opposing directions about the Y axis and relative to the X-yoke 86.

It is noteworthy that the Y-yoke 110 rotates about both the X-axis (with attached gimbal frame 98) and about the Y-axis. The X-yoke is held by the support bracket 82 for translational motion only.

Figure 7:
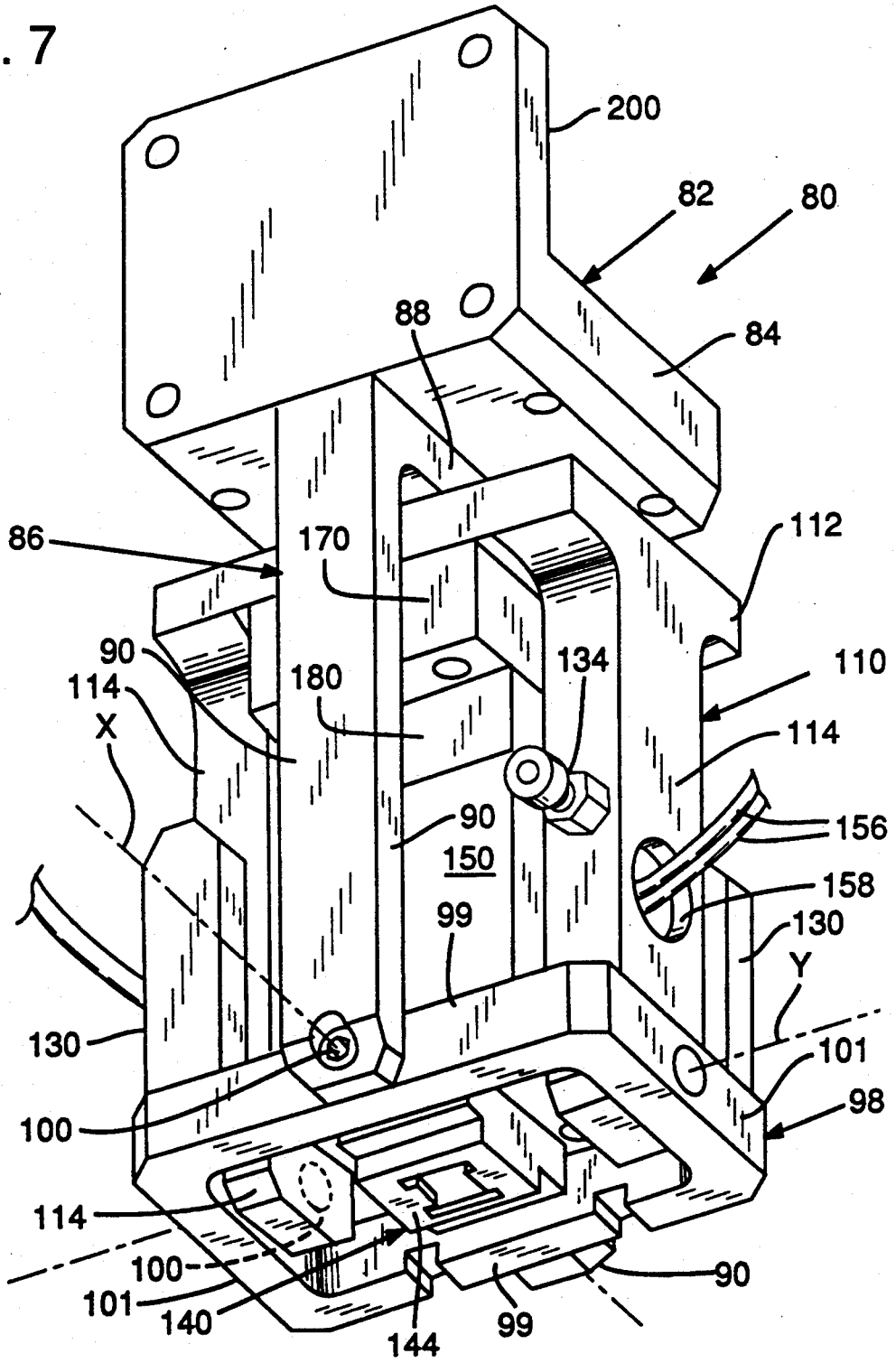
FIG. 7 is a perspective view of an assembled staking apparatus.

The gimbal frame 98 is normally supported by the flex pivots 100 so that the X and Y axes are in the same or parallel planes. This position of the apparatus 80 is hereafter referred to as the centered position (FIG. 7).

The elastic force generated in the flex pivots 100 for urging the apparatus into the centered position is complemented with a pair of X return springs 120, and a pair of Y return springs 122. More particularly, the upper surface 124 of the Y-yoke base plate 112 includes a pair of spaced apart bosses 126 over each of which fits one end of an X return spring 120. The other end of each X return spring 120 is seated within a correspondingly-shaped recess formed in the underside of the leg 84 of the support bracket 82. The X return springs, located as they are equidistant from and on opposing sides of the X axis, tend to urge the Y-yoke 110 of the apparatus (and attached gimbal frame 98) into the centered position about the X axis.

Each Y return spring 122 has one end anchored in a recess formed in the upper end of an elongated spring support 130 that extends upwardly from the gimbal frame 98, one support 130 extending parallel to a leg 114 of the Y-yoke at each corner of the gimbal frame 98. The other end of the spring 122 fits within one end of a threaded through-hole 132 formed in each Y-yoke leg 114. The opposing end of the through-hole 132 receives an adjustment screw 134. The penetration depth of the screw 134 into the hole 132 is changeable for adjusting the amount of compression in spring 122. The Y return springs 122 are adjusted to urge the Y-yoke into the centered position relative to the Y-axis.

It will be appreciated by one of ordinary skill that the assembled X-yoke 86, Y-yoke 110 and gimbal frame 98 permits the base plate 112 of the Y-yoke to move in opposing rotational directions about the X-axis, and in opposing rotational directions about the Y-axis.

The staking shoe 140 is mounted to the base plate 112 of the Y-yoke 110 as is, therefore, movable about the X or Y axis with the Y-yoke base plate 112. The staking shoe 140 applies the heat and pressure employed for staking the flexible circuit 22 to the pen body 28. The staking shoe 140 is suspended from the underside of the Y-yoke base plate 112 so that the staking surface 144 of the shoe (that is, the surface that contacts the circuit during staking, FIG. 7) is held very near and slightly below the X and Y axes. As described more fully below, the staking process may employ two staking apparatuses 80, one apparatus carrying a shoe 140 that is configured for staking part of flexible circuit 22 to the nose surface portion 38 (FIG. 6–9), and the other apparatus carrying a shoe 141 (FIG. 10e) having a surface configured for staking the remaining portion of the flexible circuit 22 to the front face 29 of the pen body 20.

Staking surface 144, which is applied to the flex circuit 22 in a manner that surrounds the print head 24, includes a central recess 146. The recess 146 is shaped similar to the print head opening 56 in flexible circuit 22 so that the shoe surface 144 does not contact the print head 24, or the beams 48 of the circuit 22 that connect with the print head 24. The contact surface of the above-mentioned second shoe 141 is flat, and shaped to match the size of the flexible circuit portion that extends along the front face 29 of the pen.

Figure 6:
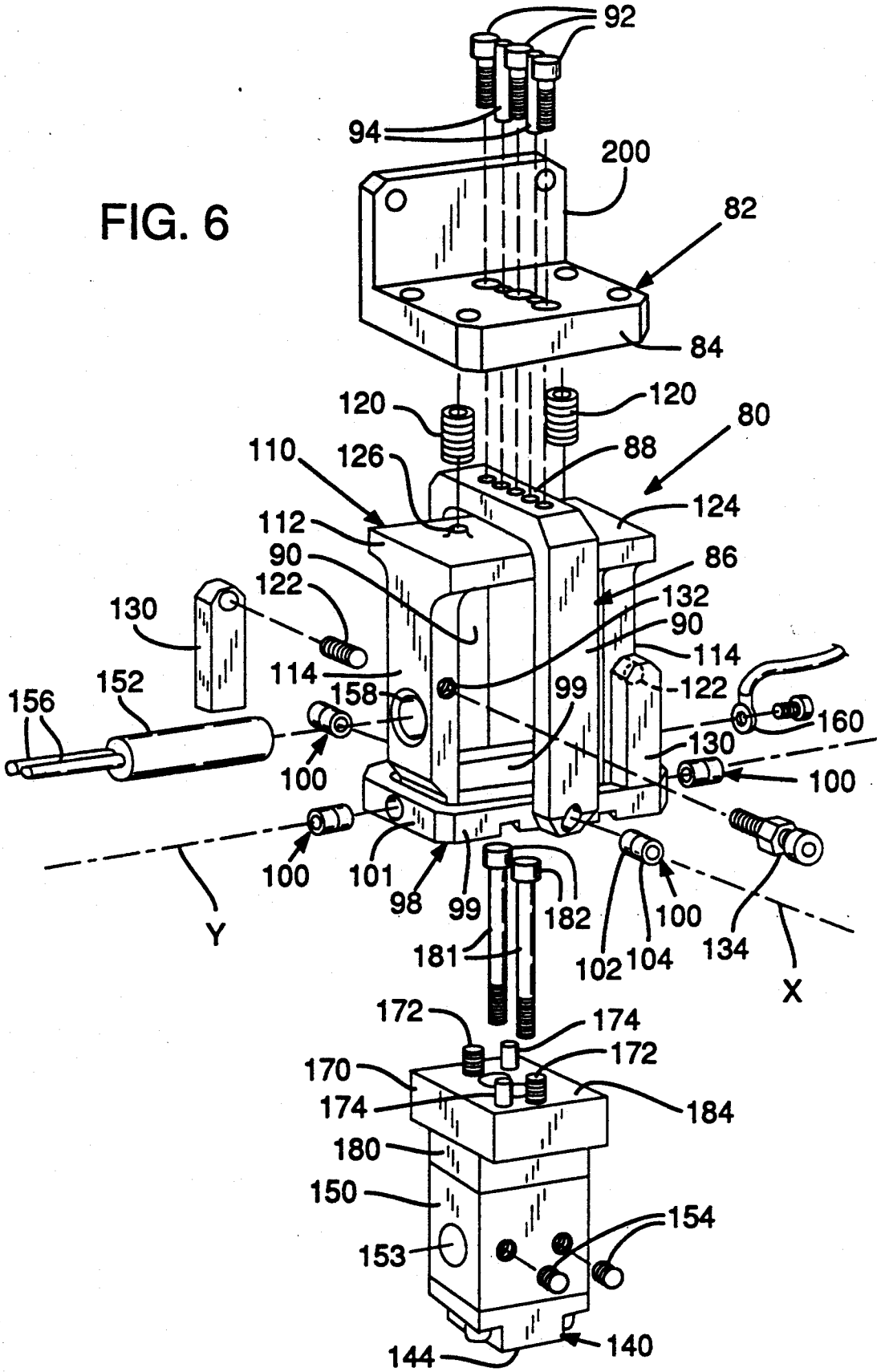
FIG. 6 is an exploded perspective view of a staking apparatus formed in accordance with the present invention.
Figure 9:
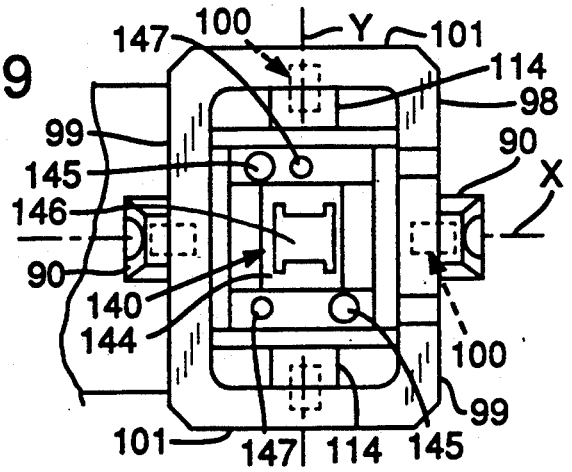
FIG. 9 is a view taken along line 9—9 of FIG. 8, showing the bottom of the staking apparatus.

As best shown in FIG. 6 and 9, the staking shoe 140 is fastened to the bottom of a metal heater block 150. Preferably, the shoe 140 is secured to the heater block 150 by fasteners 145 and alignment dowels 147 for maintaining the precise location of the shoe 140 relative to the heater block. A cylindrical heating element 152 is fit within a correspondingly-sized central hole 153 in the heater block 150 and held therein by set screws 154. The leads 156 of the heater element 152 extend through a hole 158 formed in the Y-yoke leg 114 to a conventional power source. A thermocouple 160 extends through a hole in the other Y-yoke leg 114 and is fastened to the opposing side of the heater block 150. The thermocouple monitors the heater block temperature.

A pair of ceramic insulators 170, 180 are mounted between the heater block 150 and the base plate 112 of the Y-yoke 110, thereby substantially eliminating heat transfer from the heater block 150 to the yokes 86, 110. More particularly, an upper insulator block 170 is held to the underside of the yoke base plate 112 by threaded fasteners 172. Alignment dowels 174 extend between the upper insulator block 170 and the base plate 112 for maintaining the relative alignment of the insulator block (hence, the staking shoe 140) relative to the Y-yoke 110.

A lower insulator block 180 is secured between the upper insulator block 170 and the heater block 150 by threaded fasteners 181 the threaded ends of which are threaded to the heater block 150. The heads 182 of the fasteners 181 are countersunk into the upper surface 184 of the upper insulator block 170. It will be appreciated that the countersunk fasteners 181 prevent conduction of heat from the heater block 150 to the base plate 112.

Figure 8:
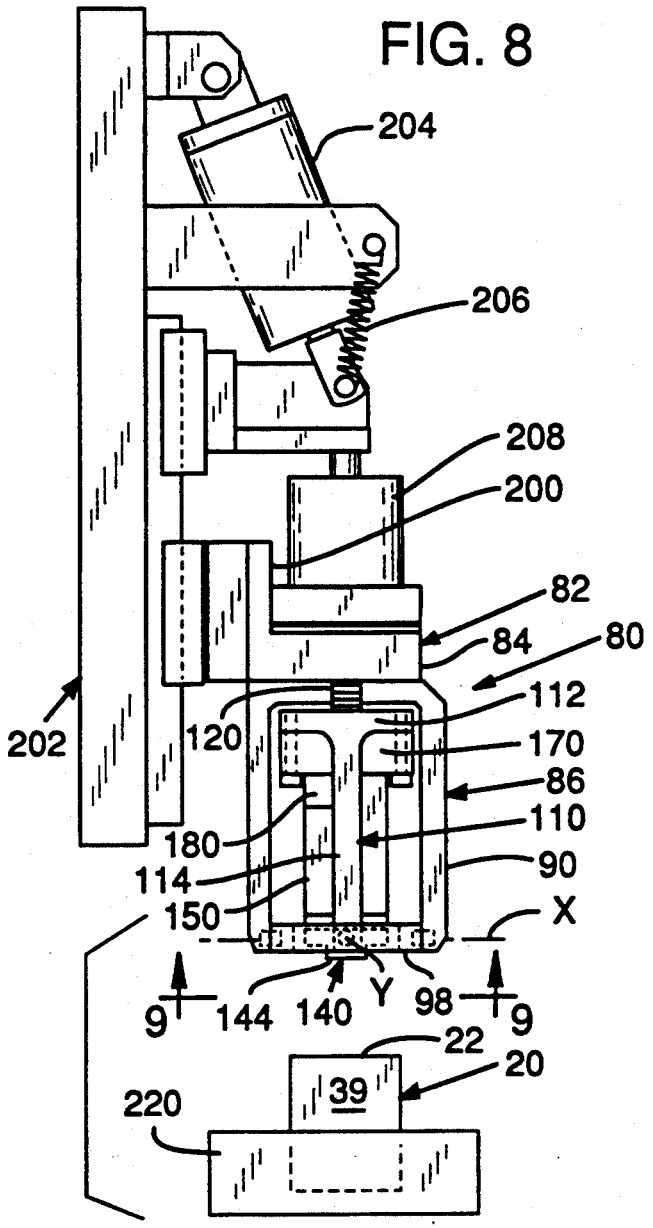
FIG. 8 is a diagram of the staking apparatus and associated mechanisms for moving the apparatus for staking a flexible circuit to a pen.

Any of a number of mechanisms may be employed for moving the staking apparatus 80 with attached shoe 140 into and out of contact with the flexible circuit 22 during the staking procedure. For example, as depicted in FIG. 8, the mounting leg 200 of the support bracket 82 can be mounted to a conventional linear bearing 202. The mechanism for moving the bracket 82 and attached staking apparatus 80 in reciprocal motion along the linear bearing 202 may be a fluid-driven actuator 204. The retraction of the staking apparatus 80 away from the pen may be assisted with a tension spring 206. In a preferred embodiment, an air spring 208 is interconnected between the actuator 204 and the support bracket 82. The internal pressure of the air spring 208 is adjusted so that a predetermined staking pressure (for example, 1.0 $kg/m^2$) is established during the time the staking shoe 140 is brought into contact with the circuit 22, irrespective of whether the actuator 204 supplies a substantially greater pressure in moving the apparatus 80 toward the pen. In short, the air spring 208 serves as a safety mechanism for ensuring that the relatively large force applied by the actuator 204 in moving the apparatus 80 is not completely applied to the staking shoe.

Figure 10A:
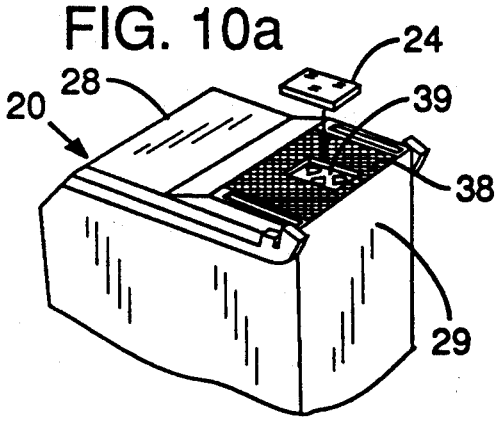
FIGS. 10*a*–10*f* depict a series of steps for carrying out the preferred method for attaching the flexible circuit to the pen, including a step for enclosing the nozzles once the circuit is attached.
Figure 10B:
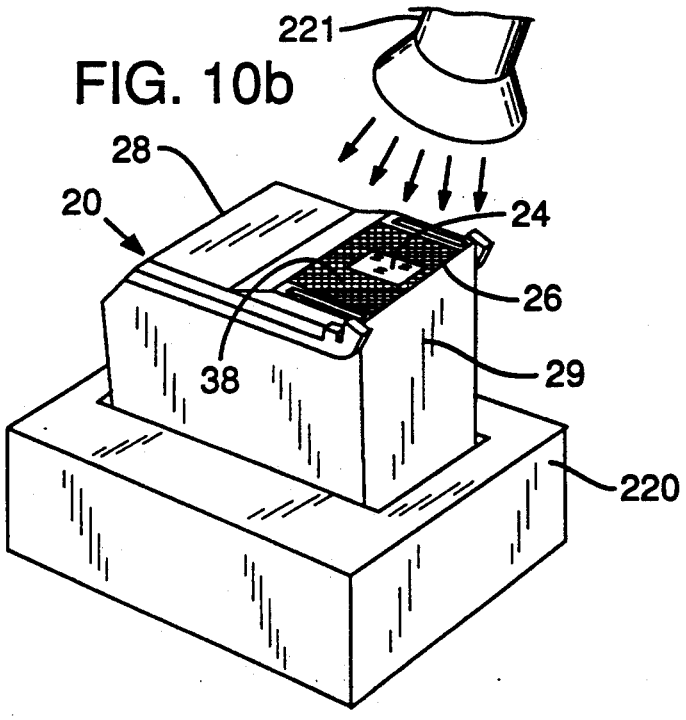
Figure 10C:
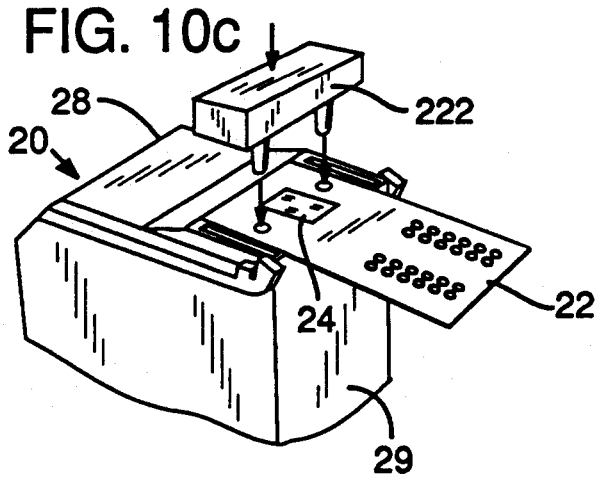

Turning now to the preferred method of attaching the flexible circuit 22 in accordance with the present invention, and with particular reference to FIGS. **10*a*–10*e*, FIG. 10*a* depicts a pen 20 held in a fixture 220. The print head 24 is installed, such as with thermal-cure epoxy adhesive, in the recess 39 in the pen nose 26 before the flexible circuit 22 is attached. The pen is then moved to a drying station, FIG. 10*b***, described next.

Preferably, the pen body 28 is formed of a thermoplastic material, such as polysulfone, which has a relatively lower melting temperature than that of the polyimide strip 46 of the flexible circuit 22. The polysulfone pen body tends to absorb ambient moisture. It has been found that if the moisture is not removed from the surface to which the circuit 22 is staked, the high staking temperature will cause the water to vaporize and introduce bubbling or blistering in the surface beneath the flexible circuit 22. Such blisters would prevent the sought-after very flat surface of the staked flexible circuit. Accordingly, at the drying station, the surface portions to which the flexible circuit will be staked are dried to eliminate moisture absorbed by the polysulfone body 28. One method of removing the moisture is to place the pen body beneath a blower 221 that supplies a forced flow of 140° C. air for about one minute.

Figure 10D:
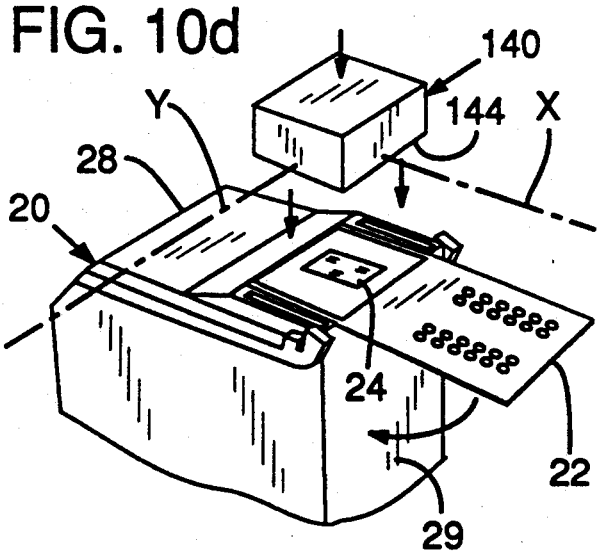
Figure 10E:
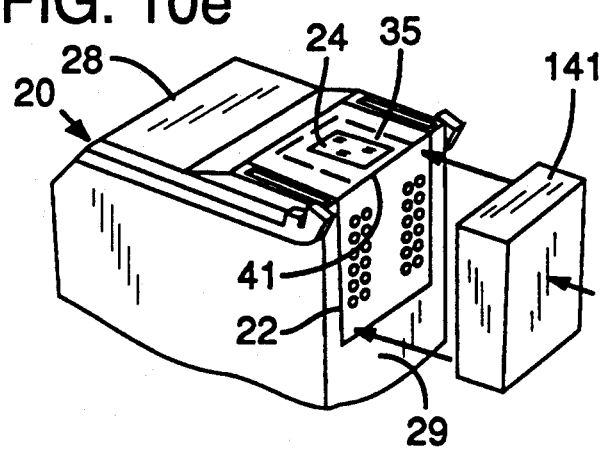

After drying, the pen is moved to a location, FIG. **10*c*, where the flexible circuit 22 is positioned so that the beams 48 of the active traces 36 (FIG. 5) are properly located relative to the print head. The circuit is then tacked in place by, for example, by heated probes, such as shown at unit 222. The fixture 220 is then moved so that the pen 20 is aligned with the staking apparatus 80 (see FIGS. 8 and 10*d***).

The staking shoe 140, which is heated via heater block 150 to a temperature of approximately 315° C. is pressed against the portion of the circuit 22 overlying the nose surface portion 38 for approximately 4.0 seconds, during which time the embossed nose surface 38 flows to bond to the flexible circuit underside and to conform to the planarity of the staking shoe surface 144.

As noted earlier, the surface portion 38 of the pen nose 26 completely surrounds the print head 24, thereby providing a flat, stable support surface beneath the flexible circuit. Accordingly, this flat surface resides beneath the entire sealing region 35 (FIG. **10*e***) of the circuit.

It is possible that during the process of constructing the pen or performing the preliminary method steps mentioned above, the plane of the nose surface 38 may not be precisely parallel with the plane of the staking shoe surface 144 as the pen is moved into the staking position (FIG. 8). The staking apparatus 80, however, provides a staking surface 144 that is rotatable about the X and Y axis, as described above, for conforming the planarity of the staking surface 144 to that of the nose surface 38. In short, as the staking shoe 140 is brought into contact with the circuit part that covers the pen surface 38, the shoe is able to pivot about the flex pivots 100 until the staking surface 144 is pressed uniformly over the entire circuit part.

Because the staking surface 144 is very near the X and Y axes about which it pivots, any such pivotal motion of the staking shoe 140 as it contacts the pen will result in extremely small displacement of the shoe surface in a direction parallel to the X or Y axis. Consequently, any rotational movement of the staking shoe 140 against the flexible circuit 22 will not cause that circuit 22 to shift along the body of the pen 22.

After the flexible circuit 22 is staked to the nose surface portion 38, each beam 48 is welded to its corresponding connection on the print head. The pen surface 29 is dried in a manner as described with respect to FIG. **10*b*, and the circuit is folded along line 41 against the front face 29 of the pen body 28. Thereafter, the folded part of the circuit is tacked in place in a manner as described with respect to FIG. 10*c*. The pen is then moved into position near a second staking apparatus (FIG. 10*e*), which may be mounted to move in a horizontal reciprocal motion, and its staking shoe 141 is pressed against the circuit 22 to stake the remaining part of the circuit 22 against the face 29** of the pen.

Figure 10F:
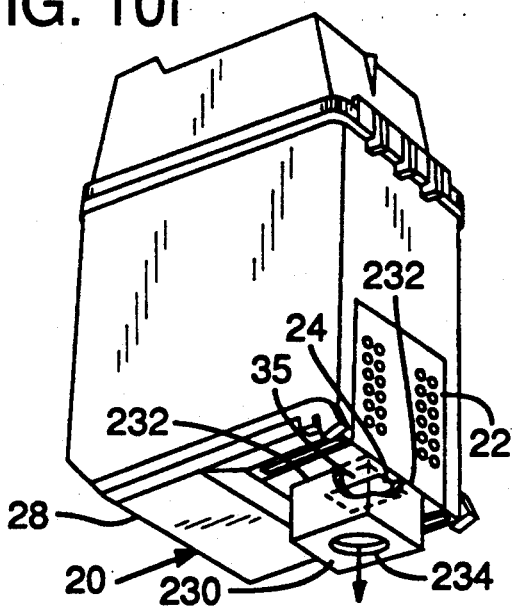

In view of the foregoing steps of attaching the circuit to the pen (FIG. **10*a*–10*e*), the sealing region 35 of the circuit defines a very flat surface surrounding the print head. As mentioned, this sealing region 35 facilitates the process of priming the pen. For example, as shown in FIG. 10*f* a generally resilient hollow cap member 230 may be moved against the flexible circuit 22 so that the upper edges 232 of the cap 230 are pressed against the sealing region 35 of the circuit. Suction may be applied to the internal chamber defined by the cap. Suction may be applied, for example, through a hole 234 in the cap 230** which connects to a suction tube (not shown).

A cap similar to that shown as 230 in FIG. 10*f* may also be used, without hole 234, for enclosing the print head during the time the pen is not in use. As with the priming version of the cap, this storage cap will seal securely against the very flat sealing region 35 provided on the flexible circuit 22.

Since the cap 230 is applied to the flexible circuit and not to the print head 24, the cap will not contact, or be placed close to, the nozzle sets 32. It will be appreciated that if the cap 230 were brought into contact with the print head, the cap may be placed too close to a nozzle set, hence defining a capillary path that may cause the ink to be wicked out of the nozzles. Such inadvertent wicking of ink from the nozzles is especially undesirable in color pens where the ink of one color may thereafter contaminate ink of another color thereby reducing print quality.

It should be understood that the embodiments described and illustrated above should be considered illustrative only, and not as limiting the scope of the invention. The invention is to include all such embodiments as may come within the scope and spirit of the following claims and equivalents thereto.

We claim:

1. A method of attaching a conductor-carrying plastic strip to the plastic body of a pen, comprising the step of staking the strip to the pen body.

2. The method of claim 1 including the step of drying a portion of the body prior to the staking step.

3. The method of claim 1 including prior to the staking step the step of forming an embossed surface on part of the body to which the strip is attached.

4. The method of claim 1 including prior to the staking step the steps of:

mounting a print head to the pen body; and surrounding the print head with part of the strip in a manner such that the surface of the part of the strip that surrounds the print head is in a single plane.

5. The method of claim 1 including the step of attaching the conductor-carrying strip to a printhead that is used for ejecting ink from the pen.

6. A method of attaching a conductor-carrying plastic strip to the plastic body of a pen comprising the step of staking the strip to the pen body wherein the staking step includes pressing the strip against the pen body with a member that is rotatably movable about two axes.

7. A method of attaching a strip of flexible material to the surface of a pen body that has a print head attached thereto, wherein the strip includes a set of electrically conductive elements attached thereto for connection with the print head, the method comprising the steps of:

forming embossments on part of the surface of the body surface to which the strip is to be attached;

drying the surface to which the strip is to be attached; and staking the strip to the body in a manner such that part of the strip surrounds the print head and so that the surface of the surrounding part of the strip is in a single plane.

8. The method of claim 7 including prior to the staking step the step of attaching to the strip a second set of electrically conductive elements that do not connect with the print head.

9. A method of attaching a strip of flexible material to the surface of a pen body that has a print head attached thereto, wherein the strip includes a set of electrically conductive elements attached thereto for connection with the print head, the method comprising the steps of:

forming embossments on the part of the surface of the body surface to which the strip is to be attached;

drying the surface to which the strip is to be attached; and staking the strip to the body in a manner such that part of the strip surrounds the print head and so that the surface of the surrounding part of the strip is in a single plane, wherein the staking step includes pressing the strip against the pen body with a member that is movable about two axes of rotation.

10. A method of attaching a conductor-carrying strip to the plastic body of a pen, comprising the steps of:

positioning an underside of the conductor-carrying strip on the exterior surface of the pen body;

applying heat and pressure to the exterior surface of the pen body to cause plastic flow of the exterior surface of the pen body such that the exterior surface of the pen body flows into conforming contact with the underside of the conductor carrying strip; and allowing the exterior surface of the pen body to cool in conforming contact with the underside of the conductor carrying strip such that the underside of the conductor-carrying strip is mechanically joined to the plastic body.

11. The method of claim 10 in which the conductors are located on the underside of the conductor-carrying strip and protrude therefrom such that the exterior surface of the pen body flows around the protruding conductors and cools in engagement with the conductors to form a mechanical connection between the pen body and the conductor-carrying strip.

12. The method of claim 10 in which the conductor-carrying strip remains solid during the application of heat and pressure to the exterior surface of the pen body.

* * * * *